US009345357B1

(12) United States Patent
Davila, Jr.

(10) Patent No.: US 9,345,357 B1
(45) Date of Patent: May 24, 2016

(54) MAGNETICALLY MOUNTED PRIVACY SCREEN

(71) Applicant: Gilberto Davila, Jr., Bronx, NY (US)

(72) Inventor: Gilberto Davila, Jr., Bronx, NY (US)

( * ) Notice: Subject to any disclaimer, the term of this patent is extended or adjusted under 35 U.S.C. 154(b) by 0 days.

(21) Appl. No.: 14/302,641

(22) Filed: Jun. 12, 2014

Related U.S. Application Data

(63) Continuation-in-part of application No. 13/200,637, filed on Sep. 27, 2011, now abandoned.

(60) Provisional application No. 61/404,065, filed on Sep. 27, 2010.

(51) Int. Cl.

| | |
|---|---|
| ***A47G 5/00*** | (2006.01) |
| ***A47H 1/00*** | (2006.01) |
| ***E06B 9/24*** | (2006.01) |
| ***A47H 99/00*** | (2009.01) |
| *A47H 23/02* | (2006.01) |

(52) U.S. Cl.
CPC ..... *A47H 1/00* (2013.01); *A47H 99/00* (2013.01); *E06B 9/24* (2013.01); *A47H 2023/025* (2013.01); *A47H 2201/01* (2013.01)

(58) Field of Classification Search
CPC A47H 2201/01; B60J 1/2094; B60J 10/0085; E06B 2009/2646; E06B 9/52; E06B 2009/527
USPC ..... 160/DIG. 16, 179, 351, 350, 354, 368.1
See application file for complete search history.

(56) References Cited

U.S. PATENT DOCUMENTS

| | | | | |
|---|---|---|---|---|
| 2,595,833 | A * | 5/1952 | Flaherty | 160/369 |
| 2,776,709 | A * | 1/1957 | Lawlor | 160/378 |
| 3,263,736 | A * | 8/1966 | Macomson | 160/370.21 |
| 3,827,019 | A * | 7/1974 | Serbu | 335/285 |
| 4,397,346 | A * | 8/1983 | Chumbley et al. | 160/84.01 |
| 4,516,620 | A * | 5/1985 | Mulhern | 160/351 |
| 4,639,033 | A * | 1/1987 | Wheatley et al. | 296/100.18 |
| 4,802,523 | A * | 2/1989 | Scholten et al. | 160/354 |
| 5,456,515 | A * | 10/1995 | Dang | 296/95.1 |
| 5,570,734 | A * | 11/1996 | Wu | 160/370.21 |
| 5,595,230 | A * | 1/1997 | Guerra | 160/135 |
| 5,732,759 | A * | 3/1998 | Wang | 160/370.21 |
| 7,600,274 | B2 * | 10/2009 | Washington | 4/608 |
| 7,600,554 | B1 * | 10/2009 | Wright et al. | 160/327 |
| 8,286,552 | B2 * | 10/2012 | Niswonger | 101/127.1 |
| 8,689,852 | B2 * | 4/2014 | Roth et al. | 160/327 |
| 8,869,694 | B1 * | 10/2014 | Niswonger | B41F 15/34 101/127 |
| 8,973,645 | B1 * | 3/2015 | Cannova | E01F 7/00 160/351 |
| 9,138,094 | B2 * | 9/2015 | Roth | A47H 1/18 |
| 2007/0144688 | A1 * | 6/2007 | Grat | 160/370.21 |
| 2010/0200180 | A1 * | 8/2010 | Lien | 160/370.21 |
| 2012/0067531 | A1 * | 3/2012 | Ehrsam | 160/368.1 |
| 2012/0261083 | A1 * | 10/2012 | Daly | 160/236 |
| 2014/0166215 | A1 * | 6/2014 | Thomas | 160/38 |
| 2015/0300078 | A1 * | 10/2015 | Porter, IV | G09F 7/00 40/600 |

* cited by examiner

*Primary Examiner* — Katherine Mitchell
*Assistant Examiner* — Johnnie A Shablack
(74) *Attorney, Agent, or Firm* — William E. Noonan

(57) ABSTRACT

A privacy screen includes a flexible panel having a hem formed peripherally about the panel. The hem includes a plurality of pockets. Each pocket accommodates a respective magnet. The magnets releasably adhere to a metallic door or frame surrounding a window or wall opening to be covered. This holds the panel over the window or wall opening to prevent viewing therethrough.

20 Claims, 8 Drawing Sheets

MAGNETICALLY MOUNTED PRIVACY SCREEN

RELATED APPLICATION

This application is a continuation in part of U.S. patent application Ser. No. 13/200,637, filed Sep. 27, 2011, which application claims the benefit of U.S. Provisional Patent Application Ser. No. 61/404,065 filed Sep. 27, 2010.

FIELD OF THE INVENTION

This invention relates to a portable privacy screen or blind for covering an interior window or other wall opening or, alternatively, an outdoor accident or crime scene. More particularly, the screen may be magnetically mounted to a metallic frame surrounding the window or wall opening. The magnetically mounted privacy screen is especially effective for use in correctional facilities, hospitals and other institutional settings. The versatile screening may also be mounted on vertical poles received by sleeves formed in the screen.

BACKGROUND OF THE INVENTION

Many types of facilities require the occasional use of privacy blinds and screens to cover windows and other wall openings in rooms or other interior spaces where privacy is required or the window/wall opening otherwise needs to be temporarily covered. For example, prisons, jails and other correctional facilities include holding cells or other rooms where inmate body searches, interrogations or other private procedures are conducted. Windows must also be blocked occasionally in intake areas, bathrooms/shower areas and other locations where opposite sexes are in close proximity but personal privacy is required. By the same token, hospitals, clinics and other medical facilities commonly feature rooms where patient examinations and other medical procedures are performed. In such circumstances, the windows, doorways and other wall openings into the room or enclosed space should be covered to protect the privacy of persons inside. Windows must also be blocked occasionally in intake areas, bathrooms/shower areas and other locations where opposite sexes are in close proximity but personal privacy is required.

Opaque or translucent window coverings also have many applications which are not strictly related to privacy. For example, photographers commonly require light blocking window coverings for a darkroom. Movie theatres should be darkened while a motion picture is playing. Truck drivers who must sleep in their vehicles may require some type of screen for blocking the windows of the vehicle so that light is reduced and sleep is facilitated. In a correctional setting, effective direct inmate observation may require the use of "one way" glass. Currently, there are no known removable window screens that provide such a one way observational capability.

Conventionally, medical and correctional facilities and other institutions employ rolling hospital screens to cover windows and provide privacy as needed. Typically, a flexible screen is supported by a folding frame mounted on wheels or casters. When a window or wall opening needs to be covered, the rolling privacy screen is moved in front of the window. This normally provides incomplete or otherwise unsatisfactory privacy. The conventional folding screen is typically not configured to match the size and shape of a particular window or wall opening. Portions or one or more windows may remain exposed and visible from outside the room. In addition, the foldable screen usually includes gaps or openings between the adjoining screen components, which provides additional unwanted exposure through the covered window.

The known rolling/foldable privacy blinds used in prisons, hospitals and other institutions exhibit a number of additional disadvantages. Such screens typically employ metal or PVC pipes in their frame, which can be removed and used as potential weapons by inmates in a jail or other correctional facility. Typically, these screens are bulky and awkward to transport around the facility. They also require a considerable amount of space, both when being used and while in storage. When the privacy screen is set up in front of a window, the hallway can be blocked. Persons can trip over the rolling screen. When the screen is not in use, it takes up valuable and limited storage space. These types of screens also require tedious and time consuming assembly and frequently have to be repaired or replaced. Folding/rolling screens are obviously not feasible for use in blocking the windows of automotive vehicles or for other applications such as darkrooms.

Although previous window blankets and bug screens have employed magnets for mounting across a window, such known devices have been unsuitable for use as privacy panels both in correctional facilities and at outdoor accident and crime scenes. The conventional products can be awkward and time consuming to install, manipulate and remove. In addition, these screens lack versatility and cannot be supported either magnetically or by non-magnetic means such as mounting poles when nearby magnetically attractive metallic structure is unavailable.

SUMMARY OF THE INVENTION

It is therefore an object of the present invention to provide a privacy screen that is particularly effective for blocking windows and other wall openings particularly in institutional settings such as correctional and medical facilities.

It is a further object of this invention to provide a privacy screen that may be secured quickly, conveniently and reliably to the metal frame of a window or other wall opening so that viewing through the window or opening is effectively and completely blocked to significantly improve privacy.

It is a further object of this invention to provide a privacy screen that offers much more complete and effective coverage of a window or other wall opening so that viewing through the window or opening is more effectively blocked and privacy is thereby improved.

It is a further object of this invention to provide a privacy screen that is lightweight and compact, which does not obstruct hallways or other interior spaces and which requires very little storage room.

It is a further object of this invention to provide a privacy screen employing a simple, yet highly effective magnetic means for mounting the screen to cover a window or wall opening.

It is a further object of this invention to provide a privacy screen that is extremely easy and quick to install and remove and where removal is especially facilitated using previously unavailable corner lifting tabs.

It is a further object of this invention to provide a privacy screen that is attractive and very easy to clean and maintain.

It is a further object of this invention to provide a privacy screen for correctional facilities, which improves security and inmate privacy, and which, unlike conventional privacy screens, cannot be readily converted to use as a weapon.

It is a further object of this invention to provide a magnetically mounted privacy screen that may be employed for a wide variety of applications and in many building and vehicle settings.

It is a further object of this invention to provide an extremely versatile privacy screen that may be used in both indoor and outdoor applications and which may be supported either magnetically, by a peripherally disposed set of magnets, or non-magnetically by supportive poles accommodated through respective versatile sleeves formed in the screen.

It is a further object of this invention to provide an extremely versatile privacy screens which are highly versatile and may be used in both indoor applications such as correctional facilities and institutional settings and outdoor applications such as accident and crime scenes.

It is a further object of this invention to provide a magnetically mounted privacy screen that employs durable and tear resistant pockets for securely and adjustably accommodating high strength magnets.

This invention features a magnetically mounted privacy screen including a flexible, visually opaque panel having a plurality of pockets formed about a periphery of the panel. Each pocket encloses a magnetic element. The magnetic elements are releasably adhered to a metallic frame surrounding a window or other wall opening for supporting the flexible panel to extend across and block viewing at least in one direction through the window or wall opening.

In a preferred embodiment, the panel includes a durable, multiple-layered construction. The panel may include a polyester fiber outer coating that is laminarly juxtaposed against a PVC backing. The panels typically have a square or rectangular configuration, although other shapes may be employed.

Each peripheral edge of the panel may be folded inwardly and sewn or stitched to an inside surface of the panel to form a peripheral hem about the panel. The hem may be formed by folding the outer polyester fiber layer inwardly against the PVC layer. The pockets are formed within the peripheral hem, typically by transversely sewing or stitching the hem at spaced apart locations. Typically, magnet-accommodating pockets are formed adjacent each corner of the rectangular panel. Additional pockets may be formed between the corners of the panel. Various pocket arrangements may be featured within the scope of this invention. Preferably, rectangular lifting tabs or flaps defining empty pockets are formed at each corner of the screen to facilitate installation and removal of the screen. Additional empty pockets formed about the periphery further facilitate lifting and manipulation of the screen.

The magnets may include small, but strong industrial strength magnets for securely, yet releasably adhering the edges of the panel to a metallic, magnetically attractive frame surrounding the window or other wall opening to be covered. Disk-shaped magnets having a diameter of ⅜" and a thickness of ⅛" with a pull force of 5.3 lbs. apiece are particularly preferred, although alternative magnet specifications (i.e. having a pull source of 20 lbs. or more) may be employed within the scope of the invention. Each pocket may include a selected spacing of preferably about one inch between an edge of the pocket and a magnet accommodated therein. This allows the magnet to be positionally adjusted within the pocket so that positioning of the screen can be adjusted. A ripstop flap or patch may be applied over the pocket to reinforce the pocket. This improves the durability of the pockets and the screen. The ripstop patch is especially effective in reducing tearing of the pockets when magnets having a pull force of 20 lbs. or more are used.

The screen apparatus is portable and extremely versatile. It may be used effectively both indoors and outdoors. In indoor applications the screen is typically magnetically mounted to a door or window frame such as in a correctional facility, hospital or other institutional setting where privacy is needed. Alternatively, in outdoor venues such as at crime and accident scenes, the privacy screen may be erected and supported non-magnetically using either the pocketed magnets or vertical sleeves that are carried by respective vertical edges of the screen panel. In magnet mounted outdoor embodiments, the magnets may be secured to the metallic body part(s) of a motor vehicle. Alternatively, the vertical sleeves may be received and be mounted on vertical poles when magnetic means of attachment are unavailable.

BRIEF DESCRIPTION OF THE DRAWINGS

Other objects, features and advantages will occur from the following description of a preferred embodiment and the accompanying drawings, in which.

DETAILED DESCRIPTION OF PREFERRED EMBODIMENTS

Figure 1:
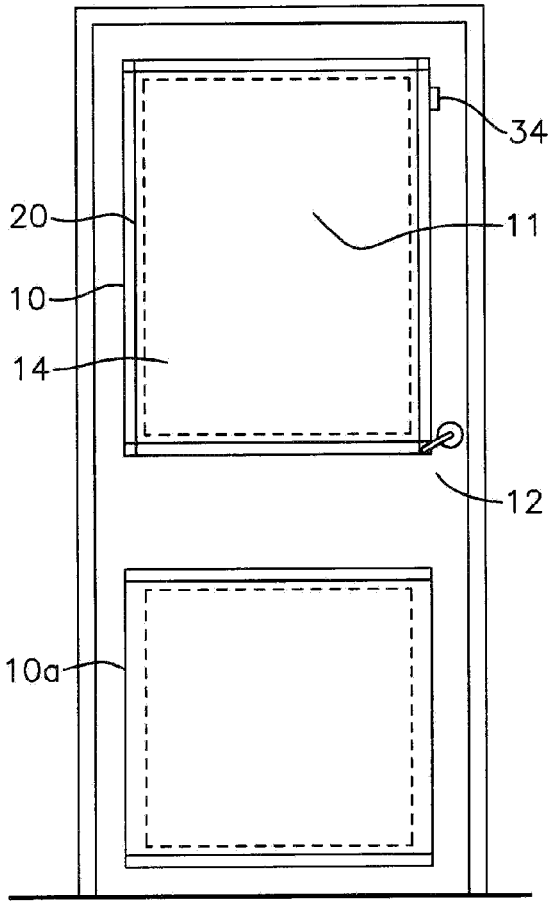
FIG. 1 is a perspective view of an interior door in a correctional facility, which door has upper and lower windows that are covered by the magnetically mounted privacy screen of this invention to block viewing through the windows.
Figure 1A:
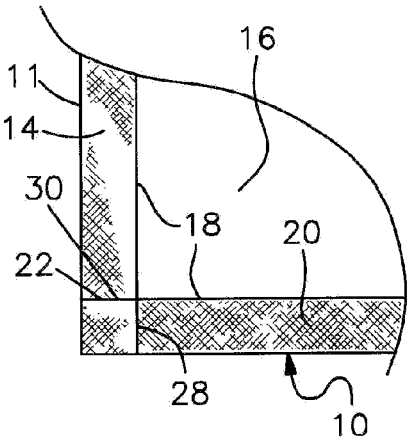
FIG. 1A is a fragmentary view of a lower corner of the inside (window facing) surface of a representative privacy screen in accordance with this invention.

There is shown in FIG. 1 a pair of magnetically mounted privacy screens or blinds 10, 10*a* for covering the upper and lower windows respectively of a standard steel door 12. This is a security door as is commonly found in jails, prisons and other types of correctional facilities. It should be understood that the privacy screen of this invention may be used to cover windows and other types of openings in a wide variety of doors, walls and other building structures. Although use of the magnetically mounted screen disclosed herein is especially effective and advantageous in correctional facilities, hospitals and other institutional settings, wherein the window or other wall opening to be covered is enclosed by a metallic frame, it should be understood that the screen may also be beneficially utilized in various other applications, such as for covering vehicle windows, darkroom windows, etc. The particular setting, venue or application in which the screen is employed does not constitute a limitation of this invention.

As shown in FIGS. 1, 1A, 2 and 4, screen 10 includes a flexible opaque panel 11 having a rectangular configuration. In particular, the screen has a durable construction that resists ripping and tearing. Panel 11 has an outer layer sheet 14 that is typically composed of a polyester fabric or similar material. Sheet 14 is juxtaposed against an inner layer sheet 16, FIG. 1A, which typically comprises a coated PVC backing. The outer edges of polyester fabric sheet 14 are folded inwardly and stitched or sewn along lines 18 (FIGS. 1A, 2) to form a peripheral hem 20 about all four edges of panel 11. Various alternative types of materials may be employed for panel 11 in accordance with the particular intended use of the screen.

A plurality of magnet-accommodating pockets 22 are formed in peripheral hem 20. In particular, hem 20 is transversely stitched or otherwise seamed, for example as illustrated by spaced apart, transverse stitch lines 24, 26 in FIG. 2. This effectively forms a respective pocket 22 in peripheral hem 20. Similar pockets are formed in each corner of screen 10 by transversely stitching perpendicularly oriented edges of the hem as indicated by respective stitch lines 28 and 30 in FIGS. 1A and 2.

Figure 2:
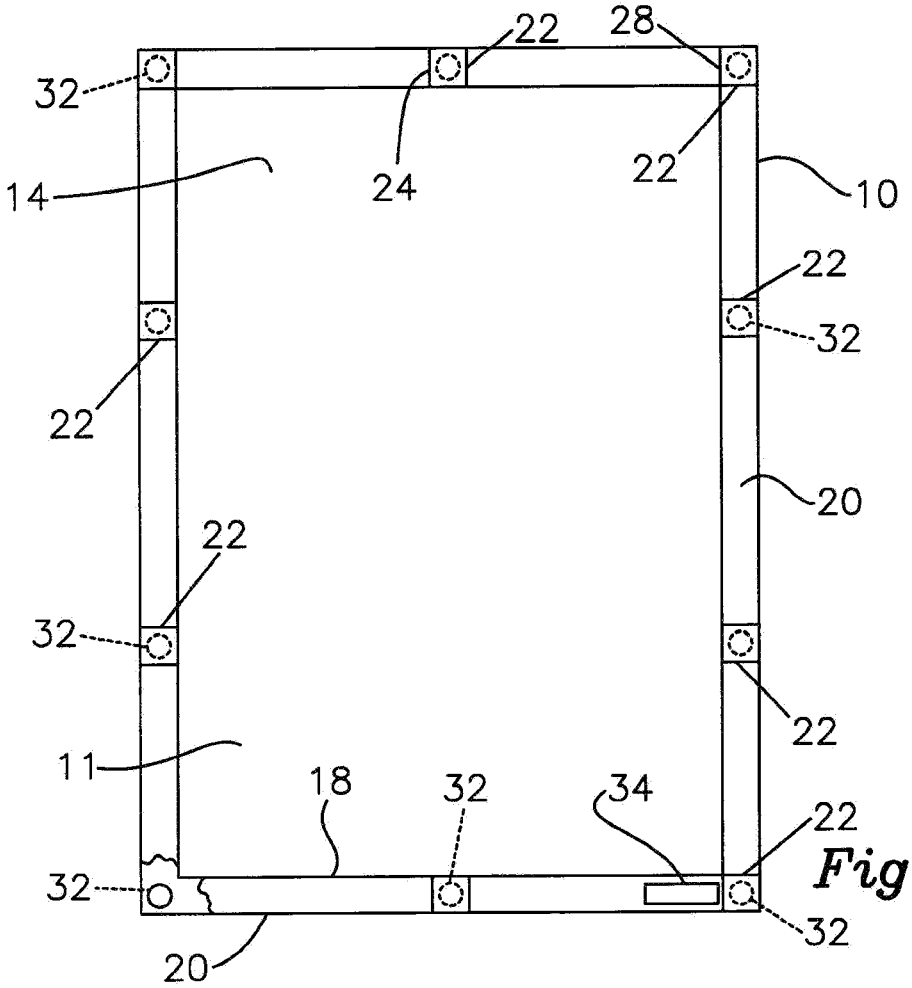
FIG. 2 is a front elevational view of the upper privacy panel disclosed in FIG. 1.

Each pocket 22 accommodates a ⅜" round by ⅛" thick industrial strength magnet 32, FIG. 2. Each magnet 32 may have a pull force of about 5.3 lbs., although alternative magnet strengths may be employed within the scope of this invention. By the same token, the magnets may have alternative sizes and shapes. Preferably, the magnets are disposed in respective pockets formed approximately 1 foot apart along the peripheral hem 20 of screen 10. A magnet 32 should be formed at each corner of the screen panel and at one or more intermediate locations along each edge of panel 11. In the embodiment shown in FIGS. 1 and 2, a pair of intermediate magnets 32 are formed along each vertical edge of screen 10 such that a total of four magnets (inclusive of the two corner magnets) are formed along each vertical edge. A single pocketed magnet is formed at the approximate midpoint of each horizontal edge of the screen. A label 34 is formed along hem 20 and may be positioned along either one of the vertical edges of the hem, as shown in FIG. 1, or one of the horizontal edges of the hem, as depicted in FIG. 2.

Figure 3:
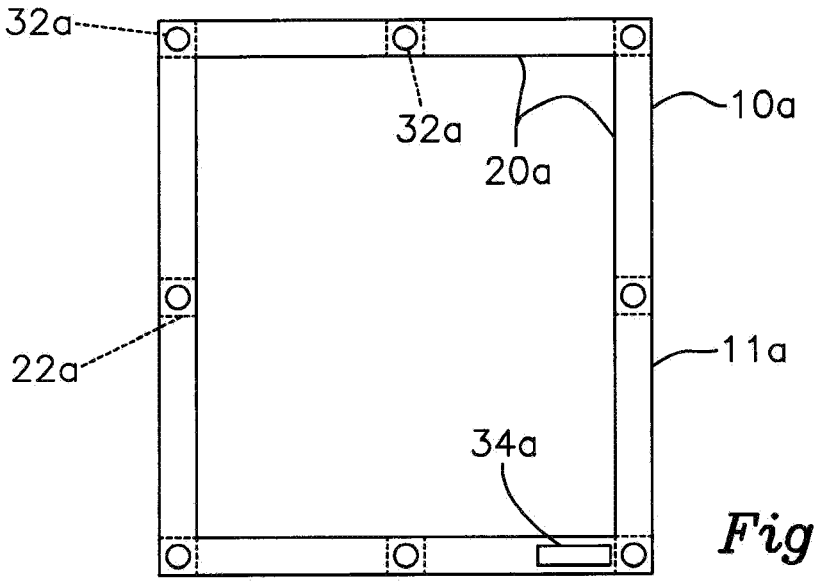
FIG. 3 is a front elevational view of the bottom privacy panel disclosed in FIG. 1.
Figure 5:
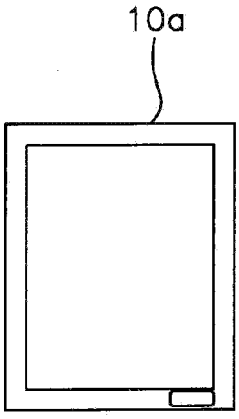

It should be understood that screen 10*a*, FIGS. 1, 3 and 5, for covering the lower window of door 12 features a construction that is analogous to that of screen 10. In particular, screen 10*a* includes a flexible, laminar sheet-like panel construction with an inner PVC backing and an outer polyester fabric layer. A peripheral hem 20*a*, which is constructed analogously to hem 20 of screen 10, is formed peripherally about panel 11*a* of screen 10*a*. The lower screen has a square or otherwise substantially rectangular shape for fitting over and blocking the lower window of door 12. Once again, a plurality of pockets 22*a*, FIG. 3, are formed by transverse stitching across hem 20*a*. Each pocket 22*a* accommodates a respective magnet, as previously described. As best shown in FIG. 3, a magnet 32*a* is mounted in this manner in each corner and at the midpoint of each of the four edges of hem 20*a*. A label 34*a* is again carried by one edge of the hem.

Figure 4:
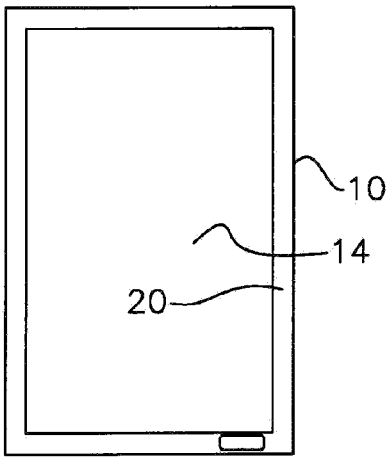
FIGS. 4-7 are front elevational views of respective magnetically mounted privacy panels in accordance with this invention.

As depicted in FIG. 4, flexible screen 10 has a preferred dimension of 38" high×28" wide. Screen 10*a*, FIG. 5, is preferably 27" square. Alternative dimensions may be employed within the scope of this invention. In any event, the screen should be sufficiently large to cover and block viewing through the window or other wall opening being screened. In particular, the peripheral hem of each screen should be engagable with the metallic door or other framework surrounding the window or wall opening being covered.

Figure 6:
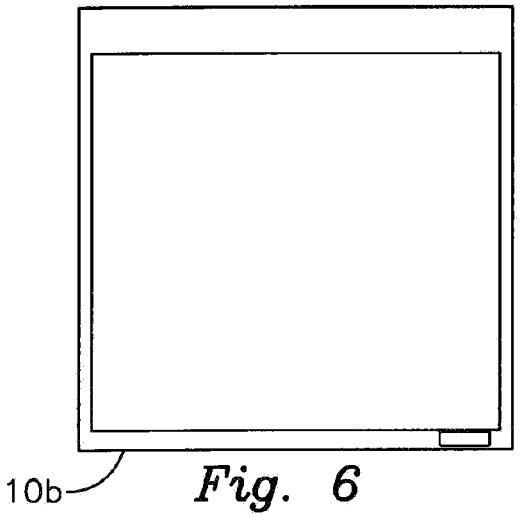
Figure 7:
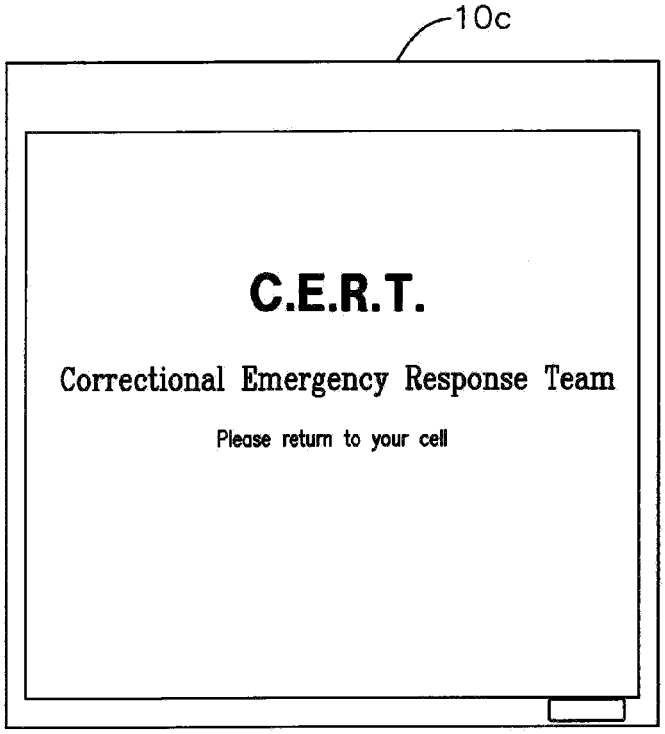

FIGS. 6 and 7 disclose respective magnetically mounted screens or blinds manufactured in the manner described above and having dimensions suited for alternative applications. In particular, screen 10*b* has a dimension of 41" high× 46" wide. This screen is made sufficiently large to cover and magnetically adhere to the periphery of a double frame window of the type commonly found in correctional facilities. FIG. 7 depicts a screen 10*c*, again manufactured analogously to the screens described above, and having dimensions of 7'×7'. A screen or blind of this size may be provided for concealing doorways and large openings of correctional facilities to provide for riot and privacy concealment. For example, screen 10*c* may be appropriate to cover shower and restroom areas, inmate dressing areas, etc.

The privacy screens of this invention are compactly folded or rolled for storage when not in use. As a result, the privacy screens take up very little storage space and do not interfere with access through hallways, doorways and interior spaces when not in use. Alternatively, as is described below in connection with FIG. 8, the privacy screen may be held magnetically in an open condition to uncover the associated window or wall opening while the screen is not being used.

To install the screens as shown in FIG. 1, each of the screens 10, 10*a* is simply unfolded or unrolled into an open condition. Upper screen 10 is then placed over the upper window of door 12 such that hem 20 is engaged with the body of the steel door peripherally surrounding or framing the window. By the same token, the hem of lower screen 10 is peripherally engaged with the door to cover the lower window. In each case, the high strength magnets contained in the pockets formed along the respective hems engage the metallic door and securely, yet releasably adhere the panels 11, 11*a* to the door such that screens 10, 10*a* cover the respective upper and lower windows. Viewing through the windows is completely blocked in the manner shown in FIG. 1. Significantly improved privacy is thereby achieved.

In FIG. 8, door 12 is again depicted, but in this case upper screen 10 is conveniently raised to an open condition to permit viewing through covered window 13. Therein upper screen 10 is opened by simply disengaging the magnets carried by the lower horizontal edge of the hem from metallic door 12 and drawing or collapsing the flexible screen upwardly to uncover window 13. This operation causes at least some of the magnets along the vertical edges of the screen to disengage the door. When the screen is raised a desired amount, the magnets at the lower corners of the screen are re-engaged with the sides of the door. During the entire operation, the magnets carried by hem 20 along the upper horizontal edge of the screen remain securely adhered to door 12. As a result, the screen is magnetically held in the open condition shown in FIG. 8.

Figure 8:
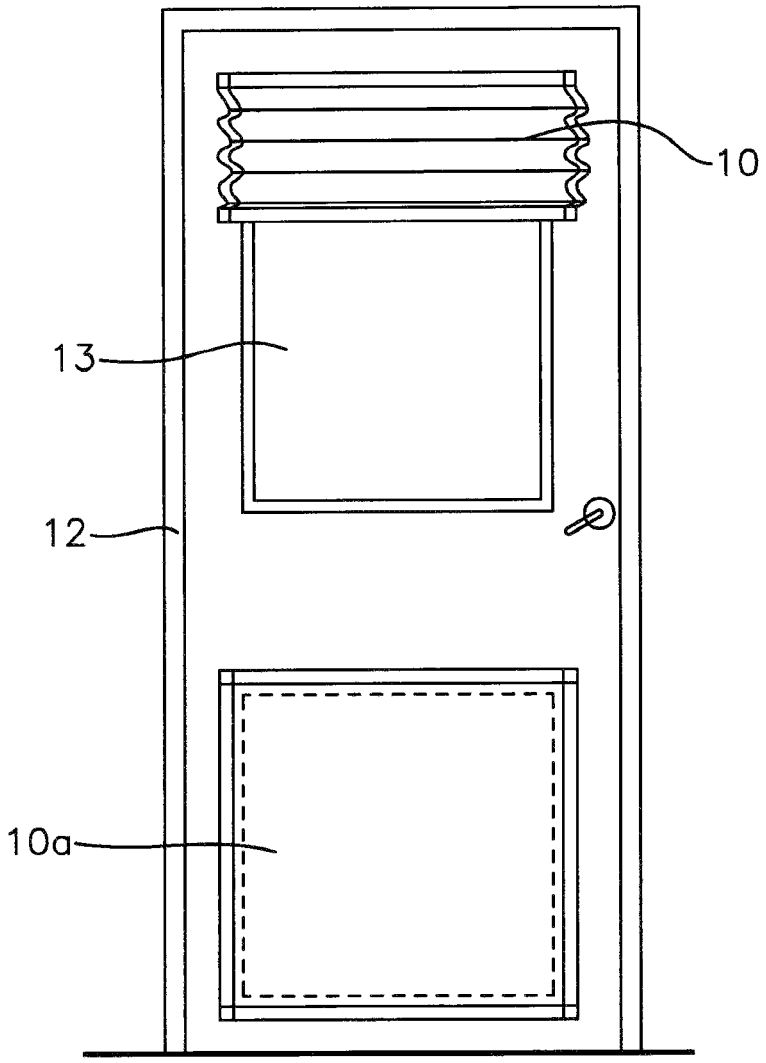
FIG. 8 is a perspective view of a correctional facility door wherein the lower window of each door is covered by a privacy screen in accordance with this invention and an upper window of each door is left uncovered by a respective privacy screen that has been raised and magnetically secured in an open condition.

Although lower screen 10*a* remains closed in FIG. 8, it should be understood that the lower screen may be raised and opened relative to its underlying window in an analogous manner to screen 10. By the same token, the privacy screens may be opened sideways in a similar manner by simply disengaging one vertical edge of a respective screen panel from the metallic door and collapsing or folding the screen sideways. In either the open or closed condition, the high strength magnets keep the screen securely engaged to the door. Opening and closing the privacy screens is therefore accomplished quickly, conveniently and reliably. In situations where privacy is required on a continuous or frequent basis, the screens may remain mounted to the door and alternated, as needed, between open and closed conditions. In these cases, the screens do not have to be removed and stored between uses.

Figure 9:
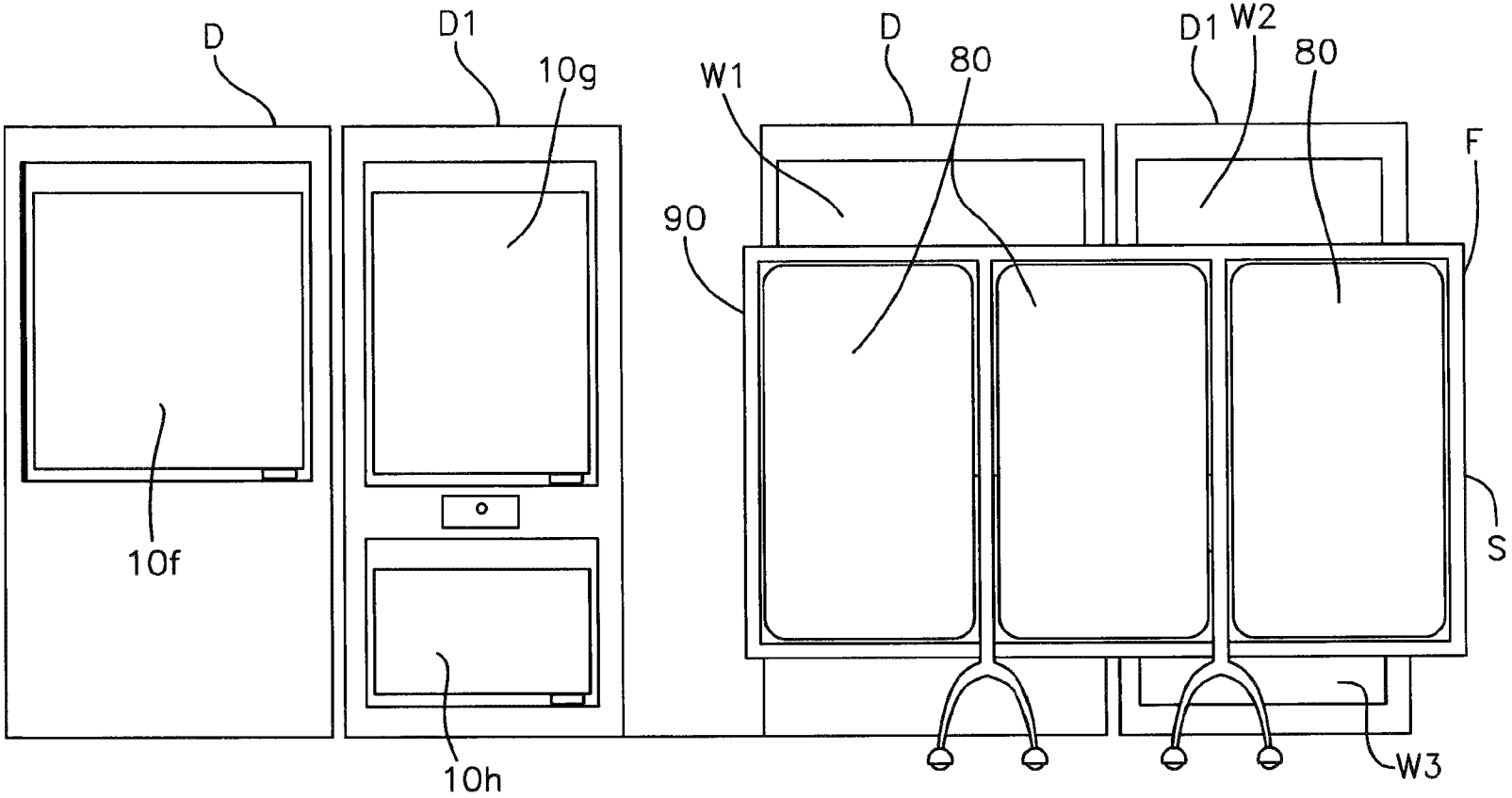
FIG. 9 is a front elevational view two pairs of doors having windows that are covered respectively by the magnetically mounted privacy screen of this invention and the prior art folding/rolling privacy screen.

FIG. 9 illustrates a pair of adjacent doors D, D1, having windows that are alternatively covered by the privacy screen of this invention and a conventional folding/rolling privacy screen S of the type previously utilized in hospitals, correctional facilities and other institutional settings. Foldable frame F supports a plurality of panels 80. As is clearly depicted in FIG. 9, screen S provides for rather poor and incomplete coverage of windows W1, W2 and W3 in doors D and D1. In particular, upper portions of windows W1 and W2 are visible above frame F. By the same token, a lower portion of window W3 can be seen below the frame. Gaps between frame panels 80 provide additional visibility through the windows. Screen assembly S is also inconvenient because it is bulky and awkward to move and set up. It also requires considerable space for storage when not in use. Moreover, the individual pipes or tubes 90 of the screen assembly can be disconnected and potentially used as weapons by inmates in a correctional facility setting. The prior screen assembly also presents an obstruction in the institution's hallway and can pose a tripping hazard.

In contrast, magnetically mounted privacy screens 10*f*, 10*g* and 10*h*, each of which is constructed in a manner analogous to that previously described, exhibit none of the shortcomings of screen S. In particular, screens 10*f*, 10*g* and 10*h* fully cover the respective windows W1, W2 and W3 in doors D and D1 and afford much better privacy than is achieved by the conventional screen assembly. Privacy screens 10*f-h* are also much easier to install and remove. The privacy screens of the present invention are lightweight and compact and require very little storage space. Indeed, as previously described, the privacy screens may remain attached to the door even when they are opened and the windows are exposed (See FIG. 8). Screens 10*f-h* are durable and require very infrequent replacement. Their flexible, lightweight construction prevents their use as a weapon. The privacy screen of this invention presents a much cleaner, neater, more ergonomic and more aesthetically appealing appearance than conventional privacy screen S. They are certainly much easier to transport between locations in an institutional facility. The privacy screen is also very easy to clean and maintain by simply wiping with a damp cloth.

Figure 10:
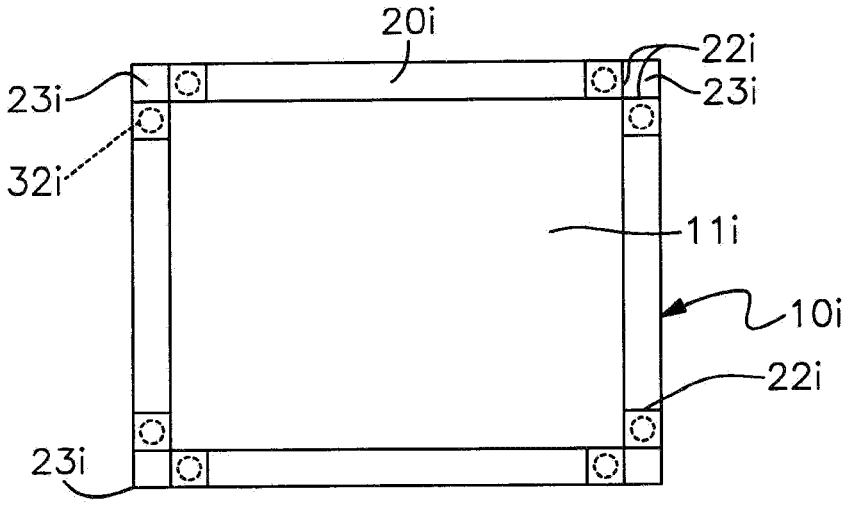
FIG. 10 is a front elevational view of an alternative panel having a pair of diagonally adjoining magnet accommodating pockets formed proximate each corner of the panel.

In the alternative embodiment shown in FIG. 10, screen 10*i* again comprises a panel 11*i*, which may be composed of various materials that are opaque when viewed from one or both sides of the screen. Indeed, such a construction may be utilized for any of the embodiments disclosed herein. A peripheral hem 20*i* is formed about panel 11*i* by folding the edges of the panel and sewing those folded edges in a conventional manner. In this version, a pair of diagonally contiguous pockets 22*i* are formed proximate each folded corner of the rectangular screen 10*i*. Each such pocket is formed, as in the prior embodiments, by transversely stitching across hem 20*i* at a pair of spaced apart locations. Each pocket 22*i* accommodates a respective magnet analogous to that previously described. In this version, the diagonally contiguous pockets 22*i* border respective sides of a rectangular corner flap 23*i* formed at each rectangular corner of panel 11*i* when peripheral hem 20*i* is formed. Each of the four resulting flaps 23*i* essentially forms an empty pocket that is devoid of a magnet and includes only the hemmed corner of the panel. Flaps 23*i* thereby define respective non-magnetic pull tabs. The pull tabs allow screen 10*i* to be conveniently pulled or lifted and separated from a door or window frame or other metal surface to which screen 10*i* is mounted. In particular, the screen is secured in place above a door, window or other opening by engaging and adhering magnets 32*i* to the surrounding frame, wall or other metal surface. The magnets magnetically adhere to the metallic surface to hold screen 10*i* in place with panel 11*i* extending across the opening surrounded by the metal surface. To remove the screen, the user simply grasps and pulls one or more of the flaps 23*i*. Sufficient force is exerted to disengage magnets 32*i* from the surrounding metal surface. This allows the screen to be quickly and conveniently removed from the previously covered window opening. The pull tabs are especially effective and beneficial because of the fairly strong and secure magnetic holding force exhibited by the magnets. The tabs allow the panel to be removed quickly and very conveniently by accessing the panel at the most readily available corner and then pulling the tab to disengage the panel from a magnetically attractive metal door or frame.

Figure 11:
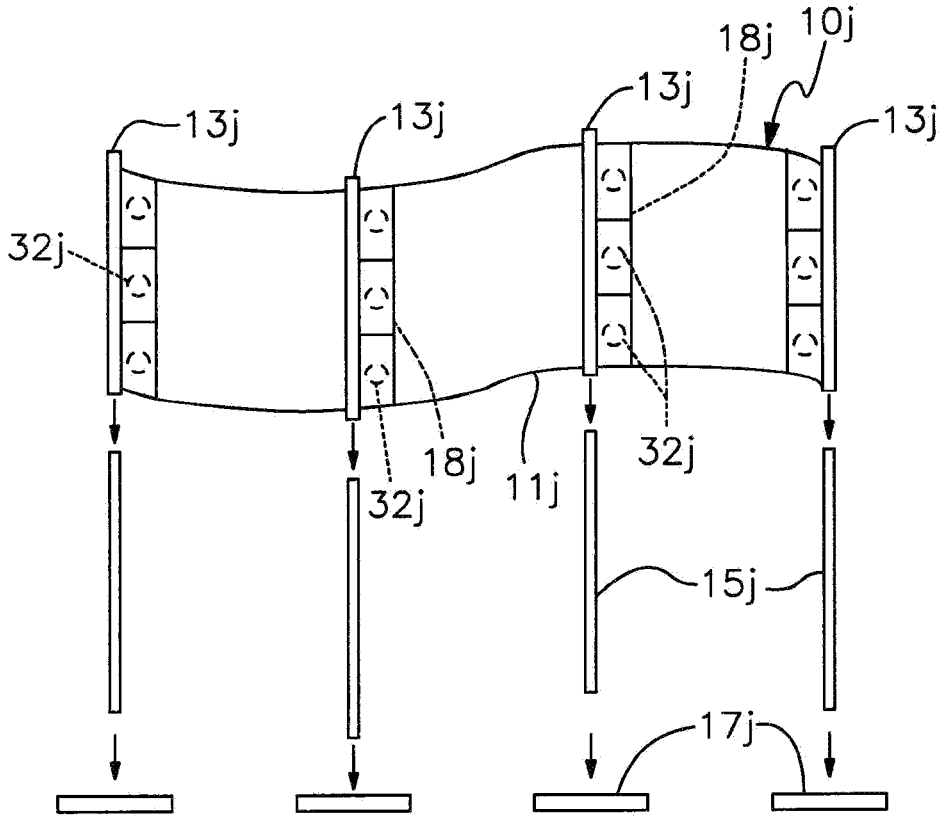
FIG. 11 is a simplified, exploded view of a roadway screen employing heavy duty magnets and spaced apart sleeves for accommodating respective support posts in accordance with this invention.
Figure 12:
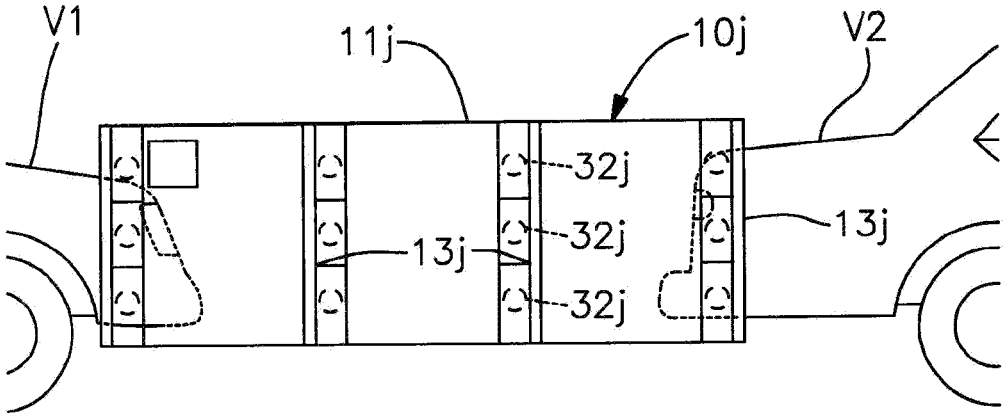
FIG. 12 is an elevational view of the roadway screen secured at each end by the magnets to respective automotive vehicles.
Figure 13:
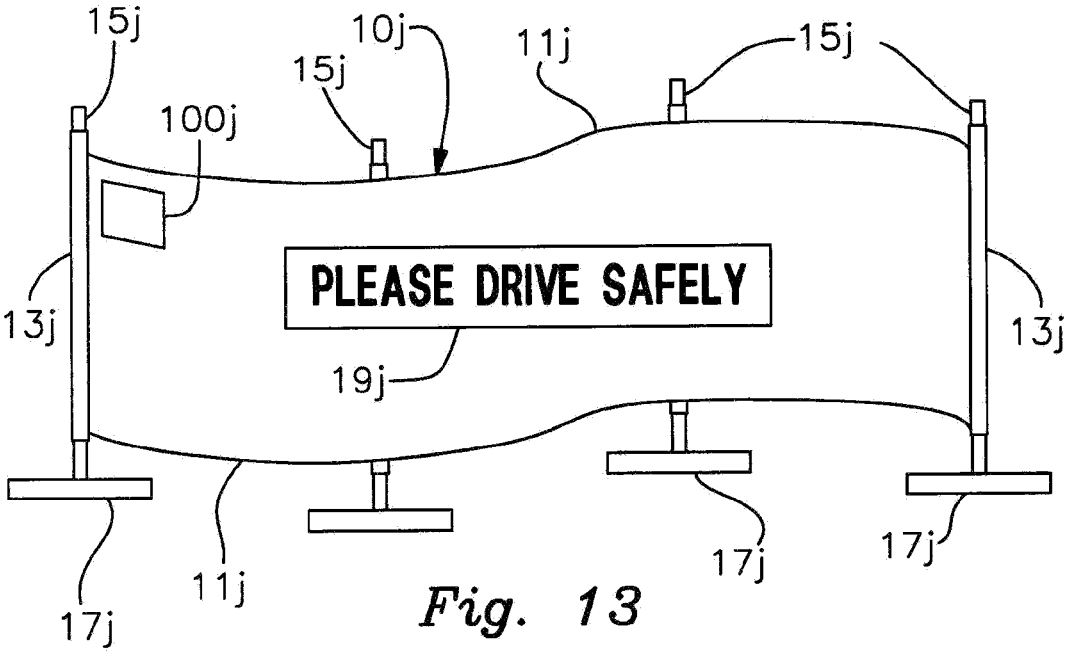
FIG. 13 is an elevational view of the roadway screen supported by the support poles alone.

FIGS. 11-13 depict still another embodiment of this invention wherein the screen is used to conceal outdoor roadside or roadway locations such as crime or accident scenes. In particular, screen 10*j* comprises a panel 11*j* composed of an opaque material. The panel has a rectangular shape, although alternative configurations may be utilized. Typically, the screen may have a side to side length of 4-16' and a height of 4-6'. Alternative dimensions may be employed.

As shown in FIGS. 11 and 12, a plurality of elongate vertical sleeves 13*j* are formed in panel 11*j* such that each sleeve 13*j* extends generally top to bottom across the panel. Various numbers of sleeves 13*j* may be formed. The sleeves are preferably spaced approximately 4' apart. Each sleeve selectively accommodates a respective support pole 15*j*, FIG. 11, in a manner analogous to that commonly exhibited by the pole-accommodating sleeves used in pool safety fences. Each support pole 15*j* is selectively engaged with and supported by a flat base 17*j*. The base may be composed of various materials, e.g. rubber, plastic, etc. and may have a vertical hole formed therein for receiving a respective support pole 15*j*. Bases 17*j* are preferably flat for stably and securely engaging the ground or other underlying surface.

As further shown in FIG. 11, a plurality of magnetic elements 32*j* are mounted to panel 11*j*. A hem 18*j* is formed adjacent to each pole receiving sleeve 13*j*. Each hem 18*j* is transversely stitched in the manner previously described to form pockets for receiving respective magnetic elements. These magnets typically comprise powerful industrial magnets having strength comparable to the magnets described in the previous embodiments.

As depicted in FIG. 12, screen 10*j* may be deployed on or near a highway in the event of a traffic accident, road hazard, graphic auto scene or crime scene in order to conceal the scene and improve traffic flow. Normally, in such situations, drivers passing such a scene tend to slow down to view the situation at hand. This can cause a traffic jam and serious traffic delays. Screen 10*j* may be deployed by police, traffic control personnel or highway officials to address this problem. In particular, as shown in FIG. 12, an accident, crime or other incident scene may be effectively hidden by stretching out screen 10*j* and engaging the magnetic elements 32*j* carried by the screen with a body, bumper or other metallic parts of one or more vehicles V1, V2. These vehicles may comprise police, emergency or highway department vehicles or simply private automotive vehicles. Because a vertical set of magnets 32*j* is carried along each vertical sleeve 13*j*, screen 10*j* exhibits a very versatile operation. The panel may be secured to one or more vehicles at various locations in order to block various sizes of gaps between the vehicles in assorted types of highway scenes. In situations as shown in FIG. 12, the support poles are not required when the stretched screen 10*j* is secured between a pair of spaced apart vehicles V1 and V2. Alternatively, one end of screen 10*j* may be secured in the manner shown in FIG. 12 and the other end may be supported by a pole engaged with a sleeve 13*j* at that end.

FIG. 13 depicts a situation in which screen 10*j* is fully supported using support poles 15*j* alone. Each pole is received by a respective sleeve 13*j* of screen 10*j*. The lower end of each pole 15*j* is supported to extend upwardly from a respective one of the previously described bases 17*j*. Once again, the magnets may be used to magnetically adhere one or more segments of the screen to a vehicle or other metallic object when such an object is available. Panel 11*j* of screen 10*j* may be printed with an appropriate message or safety warning 19*j*.

Scene concealing screen 10*j* may include a pouch or pocket unit 100*j* secured to at least one side of panel 11*j*. This unit may be utilized to hold items such as personal protective equipment, a first responder kit and/or road flares.

The panel 11*j* preferably includes a distinctive end highly visible warning color such as orange or yellow. It should be highly reflective so as to be readily visible at night. Polyurethane, PVC and other durable materials suited for outdoor use may be employed to construct the panel.

The scene concealment screen effectively obscures highway and roadway scenes of accidents, crime, distracting road hazards. As a result, on-looker gawking and resultant traffic delays and accident hazards are significantly reduced.

Figure 14:
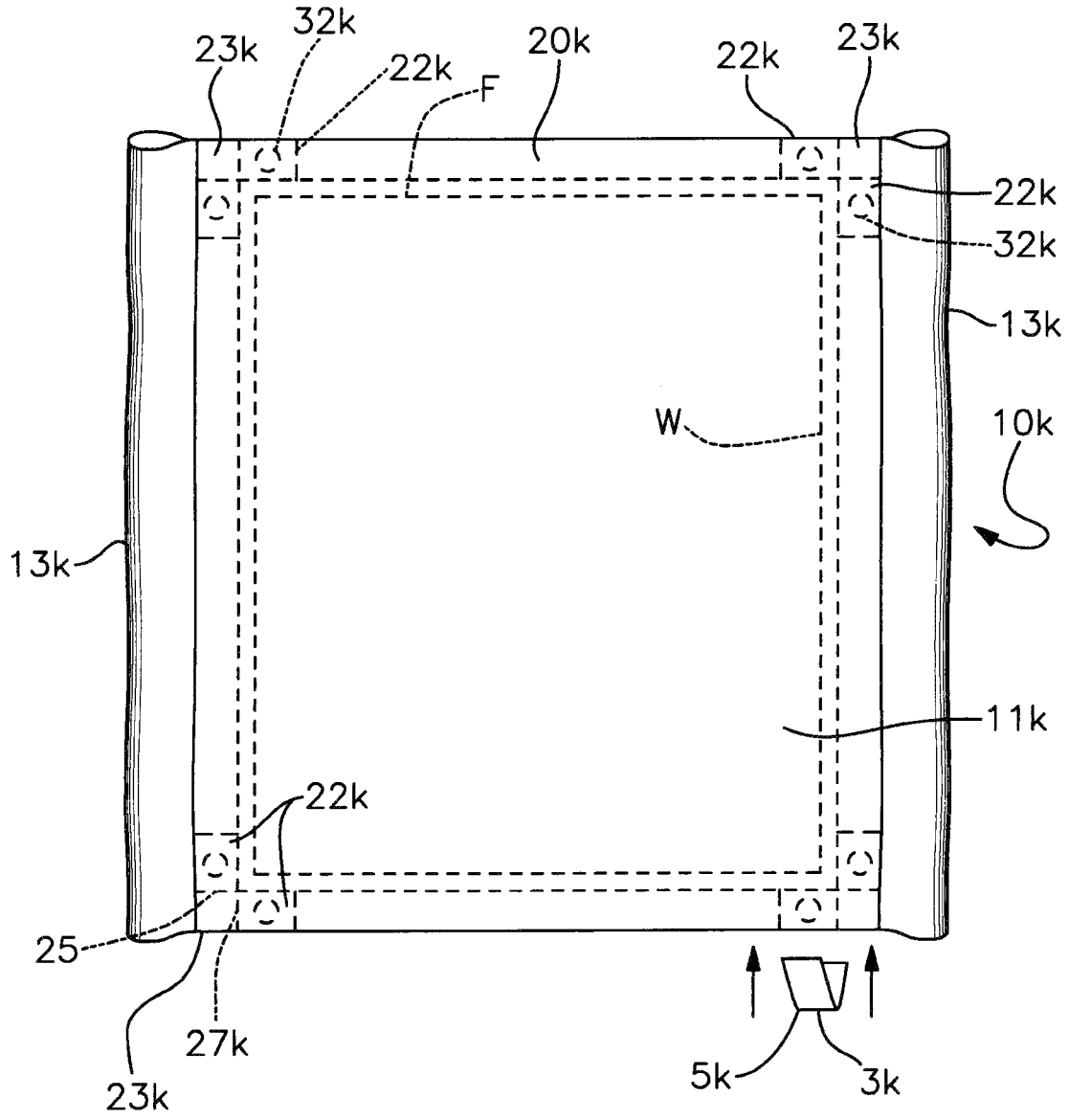
FIG. 14 is a front elevational view of a versatile version of the screen employing both mounting magnets and vertical sleeves for use in either indoor or outdoor applications.

FIG. 14 illustrates another version of the screen 10*k* covering a window W of a jail cell or other interior institutional room. A peripheral hem 20*k* is formed about the periphery of opaque rectangular panel 11*k* as previously described. Once again, each corner of panel 11*k* features a discrete, rectangular lifting flap or tab 23*k* that is devoid of a magnet. End flap 23*k* is bounded by a pair of magnet accommodating pockets 22*k* that are oriented diagonally with respect to one another about the hem 20*k* such that a lower corner of one rectangular magnet accommodating pocket 22*k* is diagonally contiguous with an upper corner of an adjacent pocket 22*k*. The lifting flap 23*k* is located intermediate the diagonally contiguous pockets 22*k* and is separated from pockets 22*k* by horizontal and vertical stitch lines 25*k* and 27*k* respectively.

Screen 10*k* further includes a pair of vertical sleeves 13*k*. Each sleeve 13*k* is attached to and extends along a respective vertical edge of panel 11*k*. Although various forms of attachment may be employed, in a typical situation, the sleeves 13*k* and the vertical sections of hem 20*k* may be manufactured by first folding the vertical edges of the panel and then forming two vertical seams to define both the vertical sections of hem 20*k* and the vertical sleeves 13*k*. Various ways of forming the peripheral hem and attached sleeves will be known to persons skilled in the art of fabric assembly.

A reinforcing ripstop patch 3*k* may be attached to hem 20*k* to cover one or more of the magnet accommodating pockets 22*k* in this version. A single representative patch 3*k* is shown in FIG. 14. It should also be understood that such a reinforcing ripstop patch may be used to cover any of the magnet accommodating pockets disclosed in the various embodiments of this invention. Patch 3*k* includes a durable, tear resistant (i.e. ripstop) fabric material that is folded along an edge 5*k* to form a pair of 3"×3" patch-halves. Each patch half is applied over hem 20*k* such that it covers one side of a respective magnet accommodating pocket 22*k*. In alternative versions, separate patch pieces may be applied respectively over the front and back of the pockets 22*k* adjoining vertical sleeves 13*k*. Each patch is fastened to the hem by stitching, adhesive or other fastening means.

The reinforcing patches 3*k* greatly improve the durability of the screen. In particular, the applied patch 3*k* helps its covered magnet accommodating pocket to better resist tearing and premature deterioration. This can be a particular problem when strong magnets, such as those having a pull force of 20 lbs. or more are employed in the pockets. Without the reinforcing patch 3*k*, the pocket 22*k* holding such a magnet is extremely susceptible to stress and tearing when the magnet is disengaged from an underlying door or window frame. Patch 3*k* improves the strength of the pocket considerably and therefore increases the useful life of the screen. As a result, there is much less need to repair or replace damaged screens. Cost savings and improved screen performance are therefore realized.

In each of the versions disclosed herein, the magnet accommodating pockets are configured to provide a spacing or approximately 1 inch between each edge of the pocket and the accommodated magnet, at least when the magnet is centered within the pocket. This provides a degree of play within the pocket so that the magnet may be positionally adjusted within the pocket easily by the user's fingers. This allows the screen to be conveniently adjusted within a door or window frame.

Screen 10*k* provides for an extremely versatile product that can be used in a wide variety of both indoor and outdoor applications. As previously described, the screen may be installed quickly, conveniently and effectively to provide a privacy panel for interior rooms and spaces within correctional facilities, hospitals and other institutional settings. In such applications, magnetic elements 32*k* within respective pockets 22*k* are typically adhered to the metal framework F of window W. The magnetic elements hold the screen securely across the window so that viewing is totally blocked in both directions through window W. As a result, enhanced privacy is achieved.

To remove screen 10*k* from window W, the user simply grasps one of the corner lifting flaps 23*k* and pulls the screen with sufficient force such that the magnets 32*k* disengage the metallic frame F. As in the previously described embodiments, one or more additional pocketed magnets may be formed within hem 20*k* intermediate the magnets 32*k* received by pockets 22*k*. Likewise, panel 11*k* is sufficiently flexible so that the screen may be rolled, folded or collapsed in an accordion-like manner in order to store the screen when it is not in use. The accordion-like collapsibility of the screen also allows it to be partially opened so that some viewing is permitted through the window in a manner previously described. (See FIG. 8.) As in the above described embodiments, the screen does not include bars, rods or other pieces that may be used as possible weapons. The product is quickly and easily installed or removed as needed and is likewise conveniently stored when not in use.

During the usage depicted in FIG. 14, the vertical sleeves 13*k* are held along the respective sides of the panel but are not utilized. Screen 10K may alternatively be removed from over a door or window and used in a manner such as shown in FIGS. 11-13. Specifically, when the screen is removed from an interior window, it may be installed on poles as shown in FIGS. 11 and 13. Each sleeve 13*k* is open for its entire vertical length so that that a respective pole is conveniently received by each sleeve. Alternatively, the magnets mounted in respective pockets of the hem may be engaged with the metallic parts of motor vehicles or other metallic components to hold the screen across a particular opening. In this way, the privacy screen may be used effectively to conceal accident and crime scenes, as well as in other applications where privacy or security are required. The pole mounted version of the privacy screen is most commonly used in outdoor applications, but may also be used in indoor applications.

The screen of the present invention is therefore conveniently portable and extremely versatile. It may be employed in a wide variety of indoor and outdoor applications, which makes the product extremely convenient for use by governmental agencies such as police departments, correctional facilities, EMT's etc.

The privacy screen of this invention may be used in a wide variety of applications and venues, including but not limited to prisons, jails, correctional facilities, fire departments, police departments, EMS services, medical facilities, industrial sites, schools, office buildings, garages, construction sites and movie theatres. The screen may also be used effectively to black out vehicle windows. A truck driver can effectively cover the windows of his cab to facilitate sleeping in the vehicle. The screen may also be used as a blackout blind for photographic darkrooms. In certain applications, the panel may incorporate one-way viewing technology that allows the screen to be used effectively by correctional and law enforcement officials for interrogation and observational purposes.

The magnetically mounted panels of this invention may also be used effectively to mount protective wall shields against elevator walls and for similar applications. In each application of this invention, the panel/screen is quickly and conveniently mounted to a vertical surface by hand and without requiring extra tools, fasteners or installation equipment.

The screen of this invention provides for significantly improved privacy in an assortment of institutional settings. For example, the screen may be used effectively in correctional facilities to provide improved privacy for inmates undergoing bodily inspections. The screen may be also used to provide improved privacy in inmate dressing areas, showers and restrooms. The screen also improves privacy where inmates of different sexes would otherwise be in close proximity and visible to one another.

In hospitals and other medical environments, the screen presents a significant improvement over rolling/folding hospital screens. This is especially important in view of recently adopted privacy (HIPPA) requirements imposed upon the medical industry. Examinations and medical procedures can be performed with a much greater degree of patient privacy.

The screen serves as an attractive concealment and inmate control device in jails, prisons and other correctional facilities. Such locations may, on occasion, be faced with a riot, crime scene or other event requiring the control of a number of inmates. A larger and/or custom sized screen in accordance with this invention provides concealment and cover for law enforcement officials and provides such officials with a tactical advantage when entering and securing a correctional location.

Accordingly, the present invention relates to a privacy screen or blind that is suitable for use in many different applications, and particularly for use in improving privacy in correctional, medical and other institutional settings.

From the foregoing it may be seen that the apparatus of this invention provides for a magnetically mounted privacy screen. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

What is claimed is:

1. A magnetically mounted privacy screen comprising:

a flexible, visually opaque and substantially rectangular panel having a plurality of peripheral corners and a plurality of substantially rectangular magnet accommodating pockets formed peripherally about said panel, each magnet accommodating pocket enclosing a discrete magnet, said magnets for being releasably adhered to a metal structure adjacent an opening to support said flexible panel to extend across and block viewing in both directions through the opening, each of said peripheral corners of said panel including an empty pocket defining a discrete, substantially rectangular non-magnetic corner pull tab having four substantially perpendicularly connected sides and being devoid of a magnet, said corner pull tab being intermediate a respective pair of first and second magnet accommodating pockets, which first and second magnet accommodating pockets are diagonally juxtaposed and touch one another and touch respective sides of said corner pull tab such that said corner pull tab is accessed and pulled for disengaging said magnets from the metal structure and removing said panel from the metal structure to uncover the opening, said panel being sufficiently flexible so as to be selectively rollable, foldable or collapsible to uncover the opening.

2. The screen of claim 1 in which said panel includes an elongate hem that extends along multiple peripheral edges of said panel, said hem being transversely seamed at a plurality of spaced apart locations to form within said hem a first series of pockets comprising said magnet accommodating pockets and a second series of substantially empty pockets, arranged side by side in a successively alternating pattern along said hem.

3. The screen of claim 1 in which said panel consists of a pair of laminarly juxtaposed sheets.

4. The screen of claim 1 in which said juxtaposed sheets consist of a polyester fiber outer coating sheet that is laminarly juxtaposed against a polyvinyl chloride backing sheet.

5. The screen of claim 1 in which said panel includes a peripheral hem, each of said diagonally juxtaposed magnet accommodating pockets being defined by a segment of said hem located between a respective pair of spaced-apart stitch lines formed transversely across said hem, each said corner pull tab being defined by a section of said hem bordering and intermediate a respective said pair of diagonally juxtaposed magnet accommodating pockets.

6. The screen of claim 1 in which each said magnet exerts a force of at least twenty pounds and each said magnet accommodating pocket is covered by a ripstop reinforcing patch to restrict tearing of said covered pocket when said pull tab is pulled to disengage said magnets from the metal structure and remove the panel from across the opening to restrict tearing of said covered pockets.

7. The screen of claim 1 in which each magnet accommodating pocket includes a spacing of approximately one inch between an interior edge of said pocket and said magnet accommodated therein to allow said magnet to be positionally adjusted in said pocket.

8. The screen of claim 1 in which said panel includes a plurality of vertical sleeves attached to and extending along respective vertical side edges of said panel for receiving respective support poles and a plurality of support bases for respectively holding said support poles to extend upwardly such that said panel extends across the opening to be covered.

9. The screen of claim 8 in which a vertical hem section is formed adjacent each said sleeve, each said hem having at least one said pocket formed therein for accommodating a respective said magnetic element.

10. The screen of claim 1 in which said panel includes a substantially rectangular hem that extends peripherally about said panel, each said corner of said panel including a vertical hem section and a horizontal hem section perpendicularly connected to said vertical hem section, each said pair of diagonally touching magnet accommodating pockets being formed in said vertical and horizontal hem sections of a respective said corner of said panel and being formed adjacent respective said sides of said corner pull tab, said corner pull tab being separated from one of said adjacent magnet accommodating pockets by a respective first stitch line formed transversely across said vertical hem section and separated from the other said adjacent magnet accommodating pocket by a respective second stitch line formed transversely across said horizontal hem section, said hem being devoid of a magnet in each pull tab between said respective first and second stitch lines.

11. The screen of claim 10 in which said corner pull tab is formed in said hem and includes an empty pocket devoid of a magnet.

12. A privacy screen kit for use selectively at an indoor correctional facility to cover and block viewing through an interior door or window opening separating a pair of adjoining interior spaces and in an outdoor location to conceal a crime or accident scene, said privacy screen kit comprising:

a flexible, visually opaque panel having a plurality of pockets formed peripherally about said panel;

a plurality of discrete magnets, each said magnet enclosed within a respective said pocket;

a pair of sleeve components attached to and extending along respective vertical side edges of said panel; and a vertical hem formed adjacent each said sleeve, each said hem having at least one said pocket formed therein for accommodating a respective said magnet;

said magnets for being releasably adhered in the indoor correctional facility to an indoor metallic structure adjacent to the interior door or window opening and in the outdoor location to a metallic structure proximate a crime or accident scene to be concealed, said sleeve components for being engaged in the outdoor location, with respective vertical support poles proximate a crime or accident scene, whereby said visually opaque panel is supported to extend selectively across the interior door or window opening of the indoor correctional facility to block viewing therethrough and across the outdoor crime or accident scene to conceal the crime or accident scene from view.

13. The kit of claim 12 in which said panel is sufficiently flexible so as to be selectively rollable, foldable or collapsible.

14. The kit of claim 12 in which said panel consists of a pair of laminarly juxtaposed sheets.

15. The kit of claim 12 in which said juxtaposed sheets consist of a polyester fiber outer coating sheet that is laminarly juxtaposed against a polyvinyl chloride backing sheet.

16. The kit of claim 12 in which said vertical sleeve components receive respective support poles and a plurality of support bases for holding said respective support poles to extend upwardly such that said panel extends across the opening to be covered.

17. The kit of claim 12 in which said panel has a plurality of peripheral corners each said peripheral corner including an empty corner pocket which has a substantially rectangular configuration and is devoid of a magnet, said corner pocket being intermediate and adjacent to a respective pair of first and second magnet accommodating pockets, which first and second magnet accommodating pockets are diagonally juxtaposed and touch one another, said substantially rectangular corner pocket forming a non-magnetic corner pull tab for facilitating removal of said panel from the metal structure to uncover the opening.

18. The kit of claim 17 in which each said magnet exerts a force of at least twenty pounds and each said magnet accommodating pocket is covered by a ripstop reinforcing patch to restrict tearing of said covered pocket when said pull tab is pulled to disengage said magnets from the metal structure and remove the panel from across the opening to restrict tearing of said covered pocket.

19. A privacy screen kit for use selectively at an indoor correctional facility to cover and block viewing through an interior door or window opening separating a pair of adjoining interior spaces and in an outdoor location to conceal a crime or accident scene, said privacy screen kit comprising:

a flexible, visually opaque panel having a plurality of pockets formed peripherally about said panel;

a plurality of discrete magnets, each said magnet enclosed within a respective said pocket;

said panel having a rectangular configuration and each corner of said rectangular panel including a corner pull tab intermediate and bordered by a pair of diagonally touching pockets, each diagonally touching pocket accommodating a respective said magnet; and a pair of sleeve components attached to and extending along respective side edges of said panel;

said magnets for being releasably adhered in the indoor correctional facility to an indoor metallic structure adjacent to the interior door or window opening and in the outdoor location to a metallic structure proximate a crime or accident scene to be concealed, said sleeve components for being engaged in the outdoor location, with respective vertical support poles proximate the crime or accident scene, whereby said visually opaque panel is supported to extend selectively across the interior door or window opening of the indoor correctional facility to block viewing therethrough and across the outdoor crime or accident scene to conceal the crime or accident scene from view.

20. The kit of claim 19 in which a vertical hem is formed adjacent each said sleeve, each said hem having at least one said pocket formed therein for accommodating a respective said magnet.

* * * * *